US010271670B2

(12) United States Patent
Heiman et al.

(10) Patent No.: US 10,271,670 B2
(45) Date of Patent: Apr. 30, 2019

(54) TWO BEVERAGE DRINKING LID DEVICE

(71) Applicants: Ron Heiman, Sioux Falls, SD (US); Kris Breien, Sioux Falls, SD (US)

(72) Inventors: Ron Heiman, Sioux Falls, SD (US); Kris Breien, Sioux Falls, SD (US)

( * ) Notice: Subject to any disclaimer, the term of this patent is extended or adjusted under 35 U.S.C. 154(b) by 119 days.

(21) Appl. No.: 15/413,881

(22) Filed: Jan. 24, 2017

(65) Prior Publication Data

US 2018/0206660 A1 Jul. 26, 2018

(51) Int. Cl.

| | |
|---|---|
| ***A47G 19/22*** | (2006.01) |
| ***B65D 47/06*** | (2006.01) |
| ***B65D 47/32*** | (2006.01) |
| ***B65D 43/02*** | (2006.01) |
| ***B65D 81/32*** | (2006.01) |

(52) U.S. Cl.

CPC ..... *A47G 19/2272* (2013.01); *B65D 43/0225* (2013.01); *B65D 47/06* (2013.01); *B65D 47/32* (2013.01); *B65D 81/3227* (2013.01); *B65D 2543/00046* (2013.01)

(58) Field of Classification Search

CPC ..... A47G 19/2272; A47G 19/2266; A47G 19/2205; B65D 2543/00046; B65D 2543/00055; B65D 47/06; B65D 47/10; B65D 47/12; B65D 47/122; B65D 47/123

See application file for complete search history.

(56) References Cited

U.S. PATENT DOCUMENTS

| | | | | |
|---|---|---|---|---|
| 7,614,513 | B2 | 11/2009 | Anderson | |
| 8,919,592 | B2 | 12/2014 | Buck | |
| 8,967,412 | B2 * | 3/2015 | Loging | A47G 19/2272 206/219 |
| 9,102,444 | B2 | 8/2015 | Milan | |
| 2003/0160019 | A1 | 8/2003 | Blanding | |
| 2006/0102581 | A1 | 5/2006 | Yates, III | |
| 2006/0163251 | A1 | 7/2006 | Kelstrom et al. | |
| 2007/0075081 | A1 | 4/2007 | Stokes | |
| 2009/0283535 | A1 | 11/2009 | Mesalic | |
| 2013/0233898 | A1 | 9/2013 | Resnikoff et al. | |

FOREIGN PATENT DOCUMENTS

| | | |
|---|---|---|
| KR | 101576977 | 12/2015 |

* cited by examiner

*Primary Examiner* — Stephen J Castellano

(57) ABSTRACT

A two beverage drinking lid device for attaching two separate beverage containers to a single lid allows for drinking selectively from either beverage container. The device includes a first connector coupled to a lid for coupling the lid to a first beverage container. A second connector is inset from a perimeter edge of the lid for coupling to a second beverage container wherein the second beverage container is held within the first beverage container. A first opening extends through the lid in environmental communication with the first beverage container. A spout is coupled to the lid and aligned with the second connector to be in environmental communication with the second beverage container.

8 Claims, 6 Drawing Sheets

TWO BEVERAGE DRINKING LID DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to lid devices and more particularly pertains to a new lid device for attaching two separate beverage containers to a single lid allowing for drinking selectively from either beverage container.

BRIEF SUMMARY OF THE INVENTION

An embodiment of the disclosure meets the needs presented above by generally comprising a first connector coupled to a lid for coupling the lid to a first beverage container. A second connector is inset from a perimeter edge of the lid for coupling to a second beverage container wherein the second beverage container is held within the first beverage container. A first opening extends through the lid in environmental communication with the first beverage container. A spout is coupled to the lid and aligned with the second connector to be in environmental communication with the second beverage container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
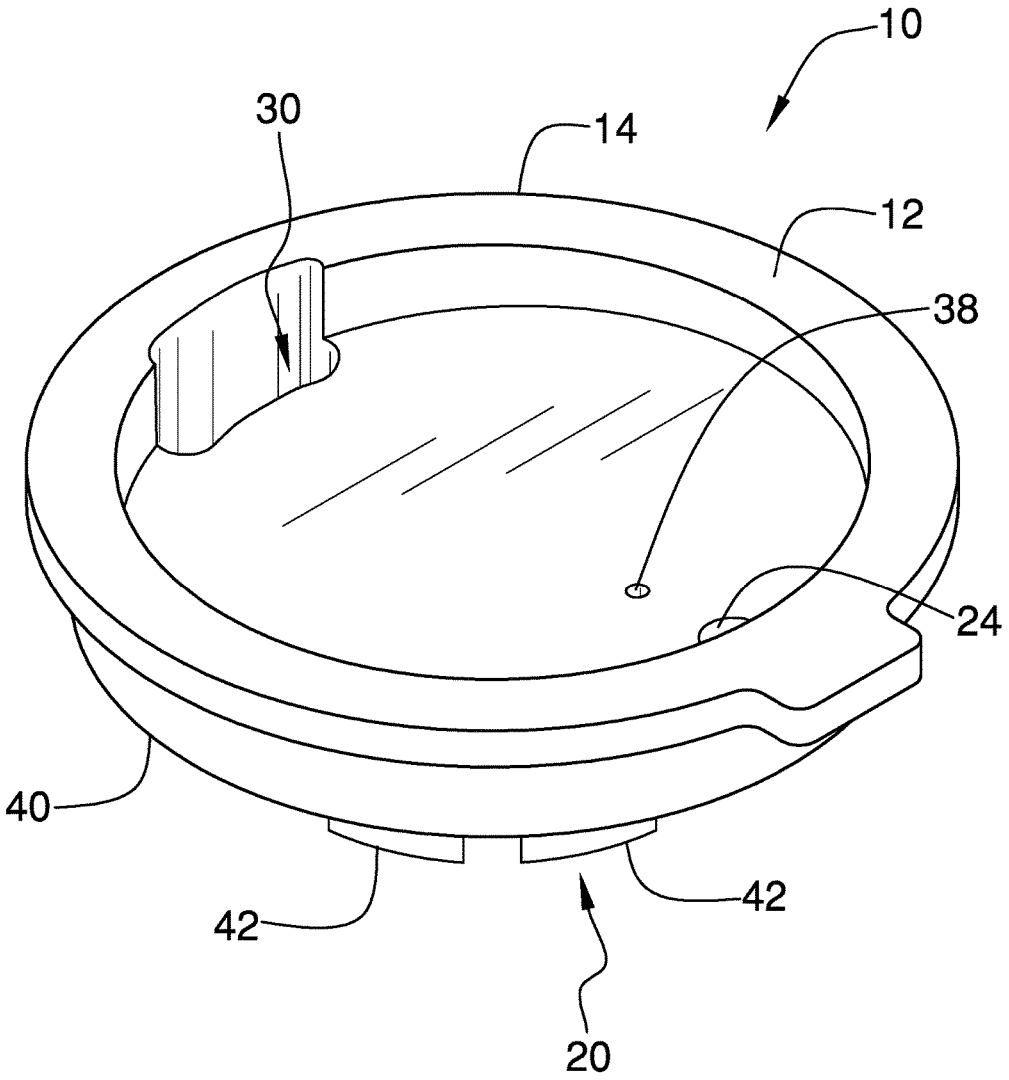
FIG. 1 is a top front side perspective view of a two beverage drinking lid device according to an embodiment of the disclosure.
Figure 2:
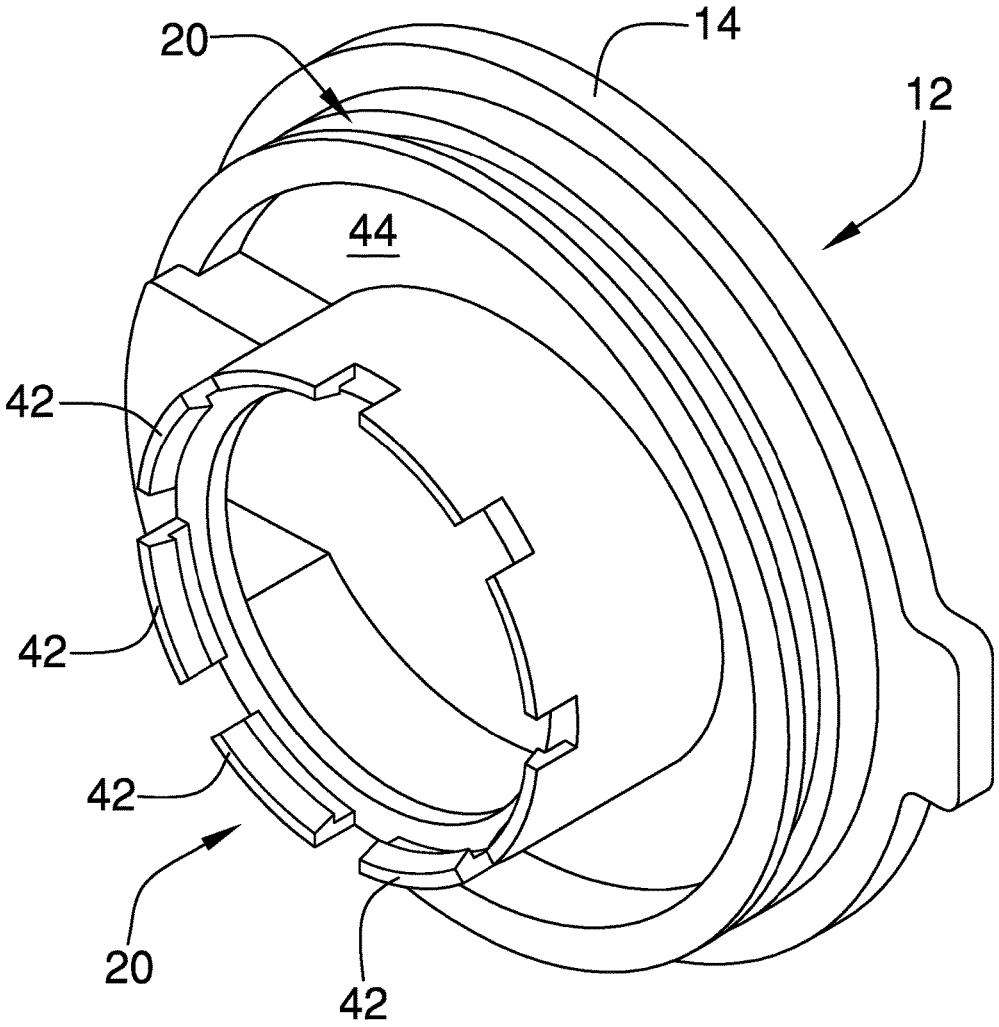
FIG. 2 is a bottom front side perspective view of an embodiment of the disclosure.
Figure 3:
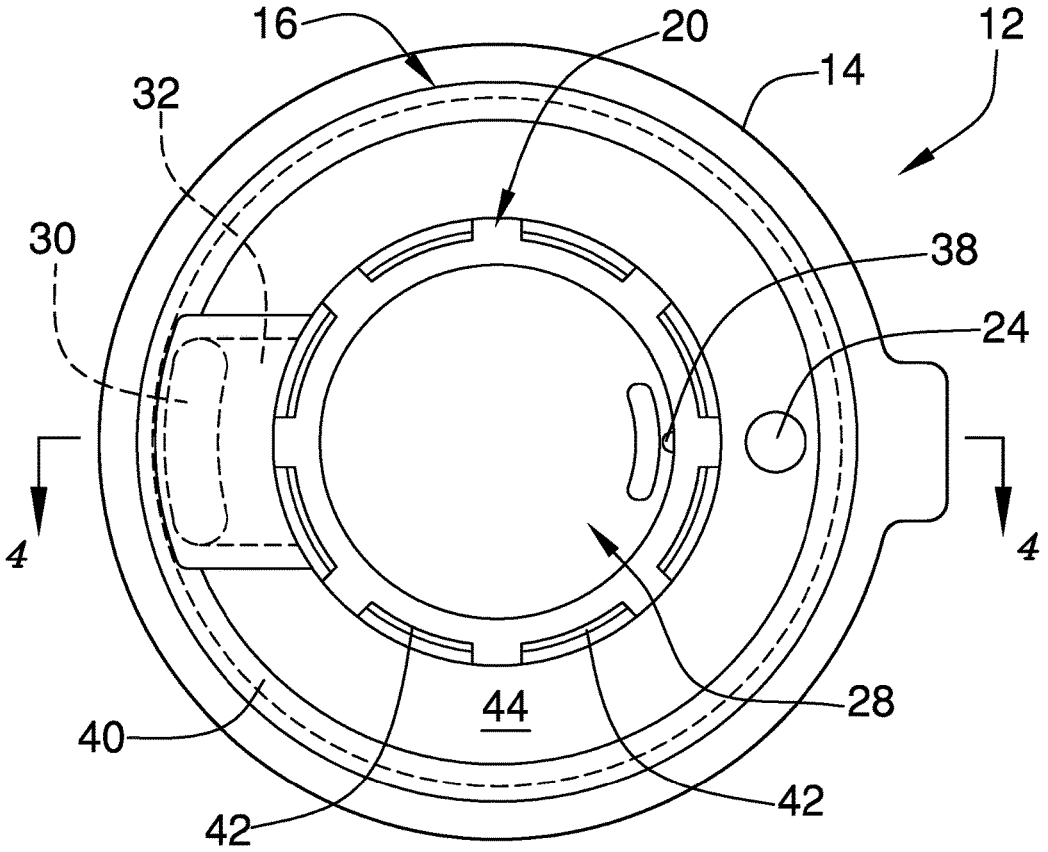
FIG. 3 is a bottom view of an embodiment of the disclosure.
Figure 4:
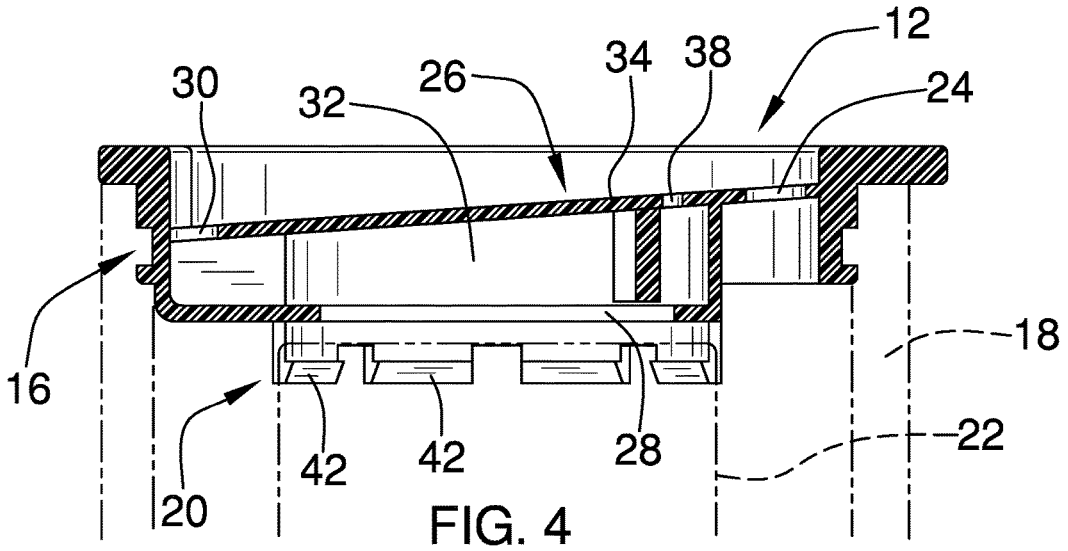
FIG. 4 is a cross-sectional view of an embodiment of the disclosure taken along line 4-4 of FIG. 3.
Figure 5:
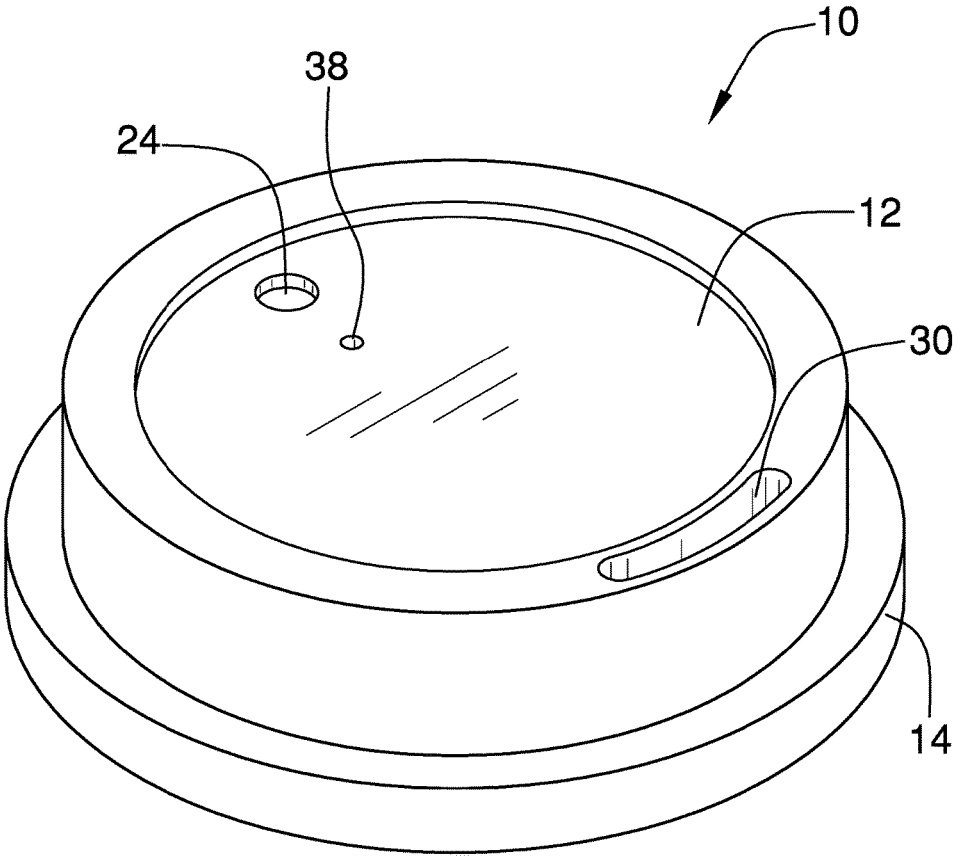
FIG. 5 is a top front side perspective view of an alternative embodiment of the disclosure.
Figure 6:
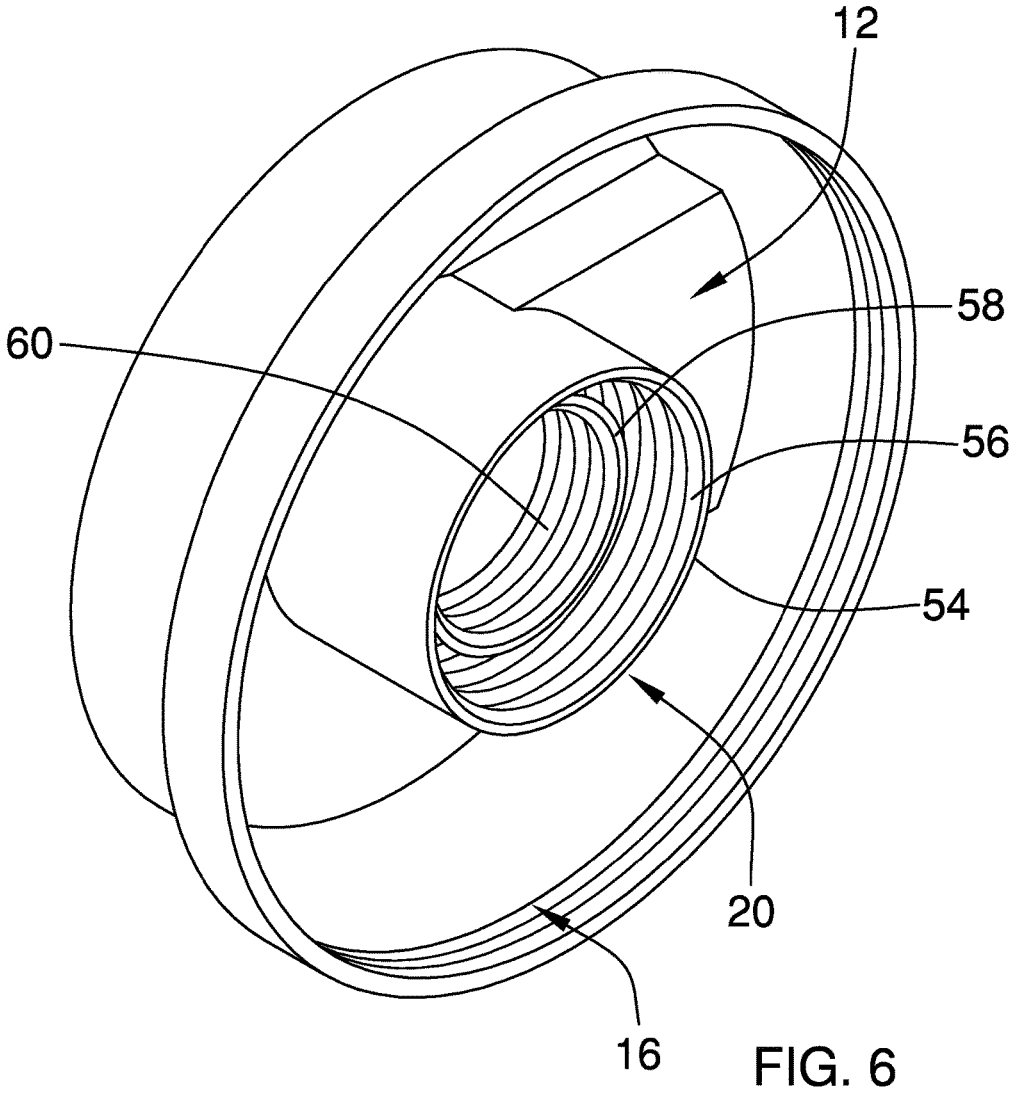
FIG. 6 is a bottom front side perspective view of an alternative embodiment of the disclosure.
Figure 7:
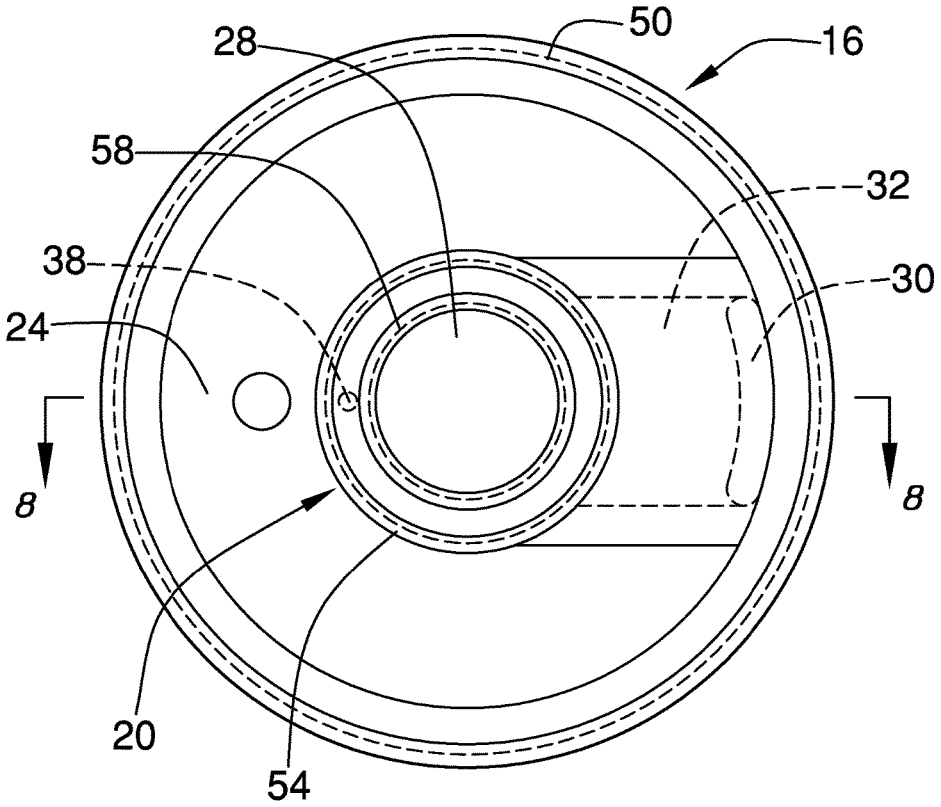
FIG. 7 is a bottom view of an alternative embodiment of the disclosure.
Figure 8:
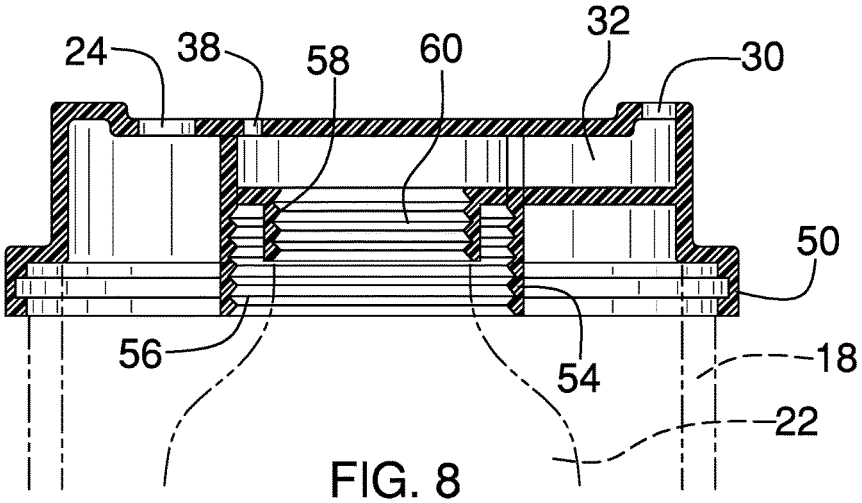
FIG. 8 is a cross-sectional view of an alternative embodiment of the disclosure taken along line 8-8 of FIG. 7.

With reference now to the drawings, and in particular to FIGS. 1 through 8 thereof, a new lid device embodying the principles and concepts of an embodiment of the disclosure and generally designated by the reference numeral 10 will be described.

As best illustrated in FIGS. 1 through 8, the two beverage drinking lid device 10 generally comprises a lid 12 having a perimeter edge 14. A first connector 16 is coupled to the lid 12. The first connector 16 extends around the perimeter edge 14 of the lid 12. The first connector 16 is configured for coupling to a first beverage container 18. A second connector 20 is coupled to the lid 12. The second connector 20 is inset from the perimeter edge 14 such that the second connector 20 is configured for coupling to a second beverage container 22 wherein the second beverage container 22 is held within the first beverage container 18. Thus, contents of the first beverage container 18 may contain ice or the like which will provide cooling to the second beverage container 22 without dilution of contents of the second beverage container 22.

A first opening 24 extends through the lid 12. The first opening 24 is positioned between the second connector 20 and the perimeter edge 14 of the lid 12 wherein the first opening 24 is configured to be in environmental communication with the first beverage container 18 when the first beverage container 18 is coupled to the lid 12. The first opening 24 may be a round hole to accommodate extending a straw or the like through the first opening 24. A spout 26 is coupled to the lid 12. The spout 26 is aligned with the second connector 20 wherein the spout 26 is configured to be in environmental communication with the second beverage container 22 when the second beverage container 22 is coupled to the lid 12. The spout 26 includes a base aperture 28, a top aperture 30 laterally offset from the base aperture 28, and a conduit 32 extending between the base aperture 28 and the top aperture 30. The top aperture 30 is positioned diametrically across the lid 12 from the first opening 24 such that tipping of the lid 12 and first and second beverage containers 18,22 elevates the first opening 24 while the top aperture 30 of the spout 26 is lowered to permit drinking from the spout 26.

In an embodiment shown in FIGS. 1 through 4, the lid 12 has a slanted medial wall 34 positioned downwardly inset from an uppermost edge 36 of the lid 12. The first opening 24 and the top aperture 30 each extend through the slanted medial wall 34. The spout 26 extends downwardly from the slanted medial wall 34. A vent hole 38 extends through the slanted medial wall 34 to be in environmental communication with the conduit 32 of the spout 26 to facilitate smooth transfer of contents of the second beverage container 22 through the spout 26. As shown in this embodiment, the first connector 16 is an exteriorly threaded peripheral wall 40 of the lid 12 and the second connector 20 is a plurality of clips 42 extending downwardly from a bottom surface 44 of the lid 12 wherein the clips 42 are configured for engaging and holding a beverage can as the second beverage container 22.

In an embodiment shown in FIGS. 5 through 8, the first connector 16 is an interiorly threaded peripheral wall 50 of the lid 12. The second connector 20 is an inner circular wall 58 having inwardly facing threads 60, the inner circular wall 58 being coupled to and extending from the lid 12 wherein the second connector 20 is configured for coupling to a threaded bottle opening as the first beverage container 18. The second connector 20 may comprise an outer circular wall 54 having inwardly facing threads 56 wherein the outer circular wall 54 is configured for coupling to a threaded opening of a first size. The second connector 20 may further comprise the inner circular wall 58 being inset from the outer circular wall wherein the inner interior wall 58 is configured for coupling to a threaded opening of a second size.

In use, the first connector 16 is configured for attaching to the first beverage container 18 which may be a pre-existing or conventional insulated cup. The first connector 16 essentially is structured to replace the coupling used for a conventional lid provided with or attachable to the first beverage container 18. The second connector 20 is used to attach the second beverage container 22, either a conventional can or beverage bottle, to the lid 12. The structure of the lid 12 prevents mixing of contents of the first beverage container 16 with contents of the second beverage container 20 allowing a person to selectively drink out of either the first beverage container 16 or the second beverage container 20 as desired. Thus, the device 10 facilitates holding of two different beverages by a single person.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A two beverage drinking lid device comprising:
a lid having a perimeter edge, said lid having a slanted medial wall positioned downwardly inset from an uppermost edge of said lid;
a first connector coupled to said lid, said first connector extending around said perimeter edge of said lid, said first connector being configured for coupling to a first beverage container;
a second connector coupled to said lid, said second connector being inset from said perimeter edge such that said second connector is configured for coupling to a second beverage container wherein the second beverage container is held within the first beverage container;
a first opening extending through said lid, said first opening being positioned between said second connector and said perimeter edge of said lid wherein said first opening is configured to be in environmental communication with said first beverage container when the first beverage container is coupled to said lid; and
a spout coupled to said lid, said spout being aligned with said second connector wherein said spout is configured to be in environmental communication with the second beverage container when the second beverage container is coupled to said lid, said spout extending downwardly from said slanted medial wall, said spout comprising a base aperture, a top aperture laterally offset from said base aperture, and a conduit extending between said base aperture and said top aperture, said first opening and said top aperture each extending through said slanted medial wall; and
a vent hole extending through said slanted medial wall, said vent hole being in environmental communication with said conduit of said spout.

2. The device of claim 1, further comprising said top aperture being positioned diametrically across said lid from said first opening.

3. The device of claim 1, further comprising said first connector being an exteriorly threaded peripheral wall of said lid.

4. The device of claim 1, further comprising said second connector being a plurality of clips extending downwardly from a bottom surface of said lid wherein said clips are configured for engaging and holding beverage can.

5. The device of claim 1, further comprising said first connector being an interiorly threaded peripheral wall of said lid.

6. The device of claim 5, further comprising said second connector being an interiorly threaded inner circular wall coupled to and extending from said lid wherein said second connector is configured for coupling to a threaded bottle opening.

7. The device of claim 5, further comprising said second connector having an outer circular wall, said outer circular wall having inwardly facing threads wherein said outer circular wall is configured for coupling to a threaded opening of a first size, said second connector including said inner circular wall being inset from said outer circular wall wherein said inner circular wall is configured for coupling to a threaded opening of a second size smaller than said first size.

8. A two beverage drinking lid device comprising:
a lid having a perimeter edge;
a first connector coupled to said lid, said first connector extending around said perimeter edge of said lid, said first connector being configured for coupling to a first beverage container;

a second connector coupled to said lid, said second connector being inset from said perimeter edge such that said second connector is configured for coupling to a second beverage container wherein the second beverage container is held within the first beverage container;

a first opening extending through said lid, said first opening being positioned between said second connector and said perimeter edge of said lid wherein said first opening is configured to be in environmental communication with said first beverage container when the first beverage container is coupled to said lid;

a spout coupled to said lid, said spout being aligned with said second connector wherein said spout is configured to be in environmental communication with the second beverage container when the second beverage container is coupled to said lid, said spout comprising a base aperture, a top aperture laterally offset from said base aperture, and a conduit extending between said base aperture and said top aperture, said top aperture being positioned diametrically across said lid from said first opening;

said lid having a slanted medial wall positioned downwardly inset from an uppermost edge of said lid, said first opening and said top aperture each extending through said slanted medial wall;

said spout extending downwardly from said slanted medial wall;

a vent hole extending through said slanted medial wall, said vent hole being in environmental communication with said conduit of said spout;

said first connector being an exteriorly threaded peripheral wall of said lid; and said second connector being a plurality of clips extending downwardly from a bottom surface of said lid wherein said clips are configured for engaging and holding a beverage can.

* * * * *